United States Patent [19]

Campbell et al.

[11] Patent Number: 4,904,092

[45] Date of Patent: Feb. 27, 1990

[54] ROLL OF THERMOPLASTIC BAGS

[75] Inventors: Pat C. Campbell; James A. Greiner, both of Palmyra, N.Y.; Bruce E. Nattinger, New Berlin, Wis.

[73] Assignee: Mobil Oil Corporation, New York, N.Y.

[21] Appl. No.: 259,840

[22] Filed: Oct. 19, 1988

[51] Int. Cl.[4] ..... B65D 33/00

[52] U.S. Cl. ..... 383/35; 383/32; 383/37; 383/70; 206/390; 206/554

[58] Field of Search ..... 383/37, 32, 35, 70, 383/42; 206/390, 554

[56] References Cited

U.S. PATENT DOCUMENTS

| | | | |
|---|---|---|---|
| 2,956,035 | 10/1960 | Mock | 206/23 |
| 3,033,257 | 5/1962 | Weber | 383/37 X |
| 3,113,715 | 12/1963 | Pangrac | 383/35 |
| 3,224,574 | 12/1965 | McConnell et al. | 383/35 X |
| 3,276,672 | 10/1966 | Heimos | 383/37 X |
| 3,348,762 | 10/1967 | Kasinkas | 206/390 |
| 3,558,400 | 1/1971 | Horvath et al. | 156/380 |
| 3,915,302 | 10/1975 | Farrelly et al. | 206/554 X |
| 3,960,062 | 6/1976 | Leloux | 93/35 R |
| 3,979,050 | 9/1976 | Cilia | 383/37 X |
| 4,015,771 | 4/1977 | Sengewald . | |
| 4,076,121 | 2/1978 | Clayton et al. | 206/390 |
| 4,285,681 | 8/1981 | Walitalo et al. | 383/37 X |
| 4,500,307 | 2/1985 | Bridgeman | 493/196 |
| 4,747,815 | 5/1988 | Benoit et al. | 383/37 X |
| 4,796,759 | 1/1989 | Schisler | 206/554 |

FOREIGN PATENT DOCUMENTS

| | | | |
|---|---|---|---|
| 0233987 | 10/1959 | Australia | 383/35 |
| 0249942 | 2/1964 | Australia | 206/390 |
| 0705748 | 3/1965 | Canada | 383/35 |
| 0003181 | 7/1979 | European Pat. Off. | 383/70 |
| 0805632 | 10/1958 | United Kingdom | 383/35 |

*Primary Examiner*—Stephen Marcus
*Assistant Examiner*—K. M. Stemann
*Attorney, Agent, or Firm*—Alexander J. McKillop; Charles J. Speciale; Michael J. Mlotkowski

[57] ABSTRACT

A continuous roll or stack of thermoplastic bags having improved openability is disclosed. The bags feature an area of permanently tacky, pressure-sensitive adhesive, applied to an outer surface of each bag. When a bag is pulled from the roll or stack, the adhesive temporarily adheres one side of the bag to the roll or stack, causing the front and back of the bag to separate slightly, thereby enhancing openability. Also disclosed are thermoplastic bags onto the surface of which an area of adhesive is applied in such a manner that the bags are self-closing when twisted shut in the area of the adhesive.

20 Claims, 1 Drawing Sheet

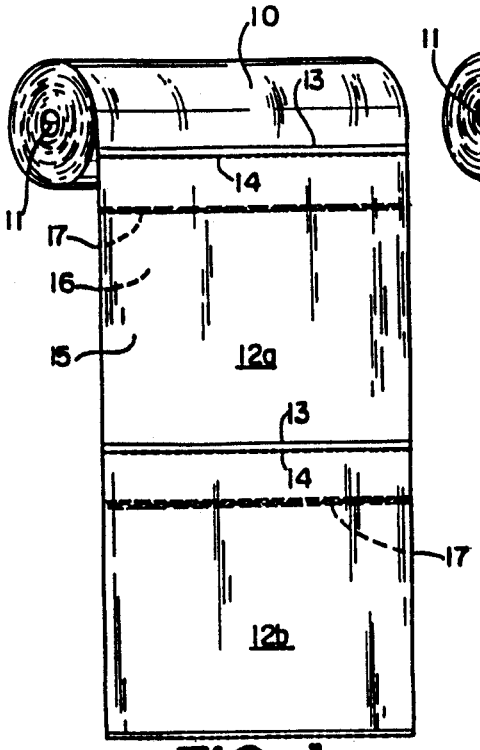
FIG. 1
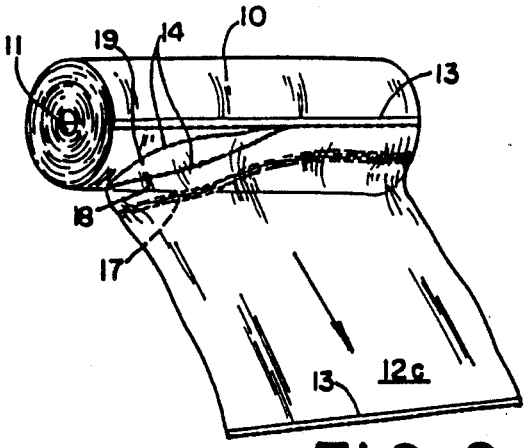
FIG. 2
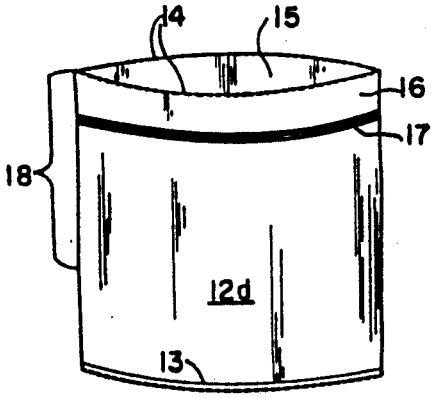
FIG. 3
FIG. 5
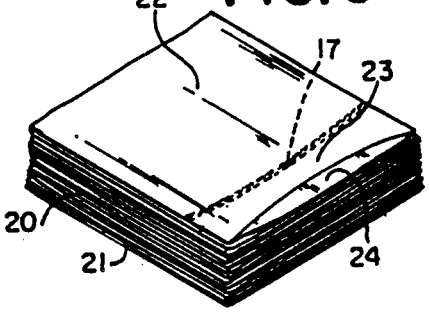
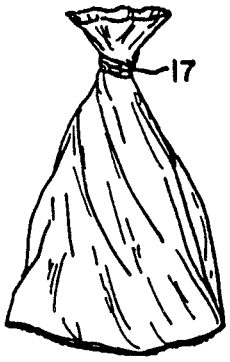
FIG. 4

ROLL OF THERMOPLASTIC BAGS

BACKGROUND OF THE INVENTION

This invention relates to improved rolls or stacks of thermoplastic bags and to thermoplastic bags with self-closing capability.

Rolls of polyethylene bags or bags of other plastic material are a standard commercial product. One well known example of such bags is a common-day plastic bag which is used for produce and bulk foods in grocery stores or supermarkets. These rolls consist generally of a tube of the plastic material, the two layers of which are sealed together at regular intervals along transverse lines, thus dividing the tube into separate pockets each of which will become an individual bag. Weakened areas, generally perforations, are provided adjacent the seals to enable the separation of each individual bag from the roll. Each individual bag thus incorporates one seal, to close one end, and a perforated opening at the other end. To use each bag, the shopper grasps and tugs the bag, tearing it from the reel along the line of perforation. Generally, the shopper closes the bag by twisting it shut and may use a separate fastening device called a twist tie if it also happens to be provided by the store.

Methods of manufacturing such rolls of bags are well known in the art. See, for example, U.S. Pat. Nos. 3,558,400 and 3,960,062.

Despite their wide commercial application, one major complaint regarding rolls of plastic bags is that they can be difficult to open. Often, the end of the bag defined by the perforations is difficult to open because the perforations can stick together during manufacture of the roll. Another major complaint regarding such plastic bags is that it is necessary to use a separate fastening device to close the bags. It is therefore desired to develop a roll or stack of bags which are more easily opened than the bags currently available and to develop bags which can be closed without the use of separate fastening devices.

SUMMARY OF THE INVENTION

The present invention relates to an improved roll or stack of continuous bags of thin plastic material. The roll or stack consists generally of a tube of the plastic material which tube is sealed to itself at regularly spaced intervals along transverse lines to divide the tube into separate bags and which tube has weakened areas adjacent the seals to enable the separation of each individual bag from the roll. The weakened area defines the top, or opening, of the bag and the sealed end defines the bottom, or closed end, of the bag upon its separation from the roll or stack. Each bag on the roll or stack has an outside front surface and an outside back surface, the outside back surface being that surface of the bag facing the core of the roll or the bottom of the stack and the outside front surface being that surface of the bag facing away from the core of the roll or the bottom of the stack. The bags can be dispensed from the roll either sealed end or open end first. The improvement comprises the addition to the outside front or back surface of each bag of an area or pattern of permanently tacky, pressure-sensitive adhesive. When a bag is dispensed from the roll or stack, adhesive on its outside back surface serves to temporarily adhere that surface to the surface of the underlying roll, causing the front and back of the bag to separate slightly and enhancing openability of the bag. Conversely, adhesive on the outside front surface of a bag serves to temporarily adhere that surface to the outside back surface of an overlying bag, again causing the front and back of the overlying bag to separate slightly when that bag is dispensed from the roll or stack.

The adhesive may also be applied to the bag in such a way that when the bag is twisted shut the adhesive will hold the twist in shape, temporarily closing the bag without the use of a separate closure device. The bag can later be opened and re-used a finite number of times without being functionally impaired due to the applied adhesive.

This invention further relates, therefore, to such bags of thin plastic material, whether dispensed from a roll or not, which possess an area of permanently tacky, pressure-sensitive adhesive capable of temporarily adhering to said thermoplastic material, which area is on an outside surface of the bag, substantially within the upper half of the bag, and whereby the top portion of the bag may be temporarily shut by twisting the bag in the area of said adhesive.

DESCRIPTION OF THE DRAWINGS

FIG. 1 shows a continuous roll of bags according to this invention.

FIG. 2 shows the method of removal of an individual bag from the continuous roll of bags of this invention.

FIG. 3 shows an individual bag according to this invention.

FIG. 4 shows an individual bag of this invention, which bag is twisted shut.

FIG. 5 shows a continuous stack of bags according to this invention.

DETAILED DESCRIPTION OF THE INVENTION

Referring to the figures, there is shown a continuous roll of bags 10 having a core 1!. The bags are formed from a thin thermoplastic film, preferably but not exclusively polyethylene film, which film is generally between about 0.20 to 1.00 mils thick. Individual bags such as 12*a* and 12*b* are joined to each other longitudinally by transversely positioned seal lines 13. Each such individual bag also has a transversely disposed weakened area 14, generally a perforated area, along which the bag may be torn from the continuous roll. Each bag has a top end defined by weakened area 14 and a bottom end defined by seal line 13. Each bag has an outside front surface 15 facing away from core 11 and an outside back surface 16 facing toward core 11. As illustrated in the figures, bags are dispensed from the roll bottom end first by being pulled in the direction of the arrow as shown in FIG. 2; however, it would also be possible to dispense the bags top end first. An individual bag 12*d* after removal from the roll 10 is shown in FIG. 3.

An area 17 of permanently tacky, pressure-sensitive adhesive, capable of temporarily adhering to said thermoplastic material, is shown on the outside back surface 16 of each bag; however, the adhesive may also be applied to the outside front surface of each bag. If the bags are to be printed on one side, it may be desirable to apply the adhesive to that same side, since the surface of the bag may be prepared identically for both such treatments. Although the area of adhesive is shown in the figures as a substantially straight, continuous strip of adhesive, the adhesive may be applied in, for example, a thin line, a series of dots or dashes, a zig-zag or other geometric pattern, or a slightly curved pattern, to name a few. The adhesive also need not be applied across the entire width of the bag, as shown in the figures, but might instead be applied in a series of patches across the width of the bag or as a single patch of adhesive. The adhesive may be applied to the bags using any number of known application devices, such as a spray nozzle system, coater or printing press. The adhesive is preferably applied within the upper half portion 18 of the bag, the upper half portion being that half of the bag adjacent to top end 14.

The adhesive is a permanently tacky, pressure-sensitive adhesive and is capable of temporarily adhering to the thermoplastic material from which the roll of bags is formed. The adhesive does not permanently adhere the surface of one bag to another, and is such that the adhered surfaces may be pulled apart without destroying or impairing the bag. When the adhered surfaces are pulled apart, the adhesive retains its tackiness, i.e., it is permanently tacky. Adhesives which are suitable for this purpose are known in the art, are preferably water-based, and include adhesives such as acrylic or polyvinyl ester copolymers. Adhesives sold under the trademark "Nacor", which are products of National Starch and Chemical Corporation, Bridgewater, N.J., are examples of such adhesives.

When bag 12c is dispensed from roll 10 as shown in FIG. 2, the adhesive 17 on the outside back surface 16 of the bag serves to temporarily adhere that surface to the underlying roll 10, causing the front and back top ends of the bag, 18 and 19 respectively, to separate slightly when dispensed. This enhances openability of the bag. For best openability, the area of adhesive is applied close to top end 14.

FIG. 5 shows a continuous stack of bags according to this invention. Stack 20 has a bottom 21, and bag 22 is shown being dispensed from said stack. Adhesive 17 on the outside back surface of bag 22 serves to temporarily adhere that surface to the underlying stack 20, causing the front and back top ends of the bag, 23 and 24 respectively, to separate slightly when in dispensed.

The area of adhesive on the bags of this invention is preferably one which functions to hold the top portion of the bag closed when the bag is twisted shut in the area of the adhesive, as shown in FIG. 4. For self closing, the area of adhesive 17 is preferably applied on about one third of the way down the bag from top end 14. To achieve self-closing, the adhesive is preferably pattern coated (strip, line, dots, patches) across the width of the bag. In this manner, when the bag is twisted shut, the tackiness of the adhesive holds the twist temporarily in shape without the need for extra closure devices. The bag is not permanently sealed or functionally impaired due to the application of the adhesive, making the bag re-usable a finite number of times.

What is claimed is:

1. A continuous roll of bags formed from thermoplastic material comprising series of individual bags each having an outside back surface facing the core of the roll and an outside front surface facing away from the core of the roll, each individual bag being joined to the next by a transversely positioned seal line which defines the bottom of the bag and each bag having a transversely disposed weakened area in the area of said seal line which defines the top of a bag, each said bag being removed from said roll by tearing along said weakened area, and each said bag having on one of said outside back or front surfaces an area of permanently tacky, pressure-sensitive adhesive, capable of temporarily adhering to said thermoplastic material whereby when removing each bag from said roll the temporary adherence of said pressure sensitive adhesive to said thermoplastic material causes the front and back surfaces at the top of the bag being removed to separate slightly.

2. A continuous roll of bags according to claim 1 where said area of adhesive is on the outside back surface of each bag.

3. A continuous roll of bags according to claim 1 where said area of adhesive is on the outside front surface of each bag.

4. A continuous roll of bags according to claim 1 where said area of adhesive is substantially located within the upper half portion of each bag.

5. A continuous roll of bags of claim 1 wherein said area of adhesive is pattern coated across the width of each said bag.

6. A continuous roll of bags of claim 4 wherein said area of adhesive is pattern coated across the width of each said bag.

7. A continuous roll of bags of claim 1 where said thermoplastic material comprises polyethylene.

8. A continuous roll of bags of claim 1 where said adhesive comprises acrylic or polyvinyl ester copolymer.

9. A continuous roll of bags according to claim 4, wherein said adhesive is effective to enable the top of the bag to be temporarily shut by twisting the bag in the area of said adhesive.

10. A continuous roll of bags according to claim 9, wherein said area of adhesive is pattern coated across the width of said bag.

11. A continuous roll of bags according to claim 9, wherein said thermoplastic material comprises polyethylene.

12. A continuous roll of bags according to claim 9, wherein said adhesive comprises acrylic or polyvinyl ester copolymer.

13. A continuous stack of bags formed from thermoplastic material comprising a series of individual bags each having an outside back surface facing the bottom of the stack and an outside front surface facing away from the bottom of the stack, each individual bag being joined to the next by a transversely positioned seal line which defines the bottom of the bag and each bag having a transversely disposed weakened area in the area of said seal line which defines the top of a bag, each said bag being removed from said stack by tearing along said weakened area, and each said bag having on one of said outside back or front surfaces an area of permanently tacky, pressure-sensitive adhesive, capable of temporarily adhering to said thermoplastic material whereby when removing each bag from said stack the temporary adherence of said pressure sensitive adhesive to said thermoplastic material causes the front and back surfaces at the top of the bag being removed to separate slightly.

14. A continuous stack of bags according to claim 13 where said area of adhesive is on the outside back surface of each bag.

15. A continuous stack of bags according to claim 13 where said area of adhesive is on the outside front surface of each bag.

16. A continuous stack of bags according to claim 13 where said area of adhesive is substantially located within the upper half portion of each bag.

17. A continuous stack of bags according to claim 16, wherein said adhesive is effective to enable the top of the bag to be temporarily shut by twisting the bag in the area of said adhesive.

18. A continuous stack of bags according to claim 17, wherein said area of adhesive is pattern coated across the width of said bag.

19. A continuous stack of bags according to claim 17, wherein said thermoplastic material comprises polyethylene.

20. A continuous stack of bags according to claim 17, wherein said adhesive comprises acrylic or polyvinyl ester copolymer.

* * * * *